United States Patent [19]

Evans et al.

[11] Patent Number: 4,866,426

[45] Date of Patent: Sep. 12, 1989

[54] MAGNETIC AMPLIFIER HOUSING AND DETECTOR FOR AN IMPROVED TAMPER ALARM SYSTEM

[75] Inventors: Mark M. Evans, Bremerton, Wash.; Roman V. Kruchowy, Somis, Calif.

[73] Assignee: The United States of America as represented by the Secretary of the Navy, Washington, D.C.

[21] Appl. No.: 208,620

[22] Filed: Jun. 17, 1988

[51] Int. Cl.[4] ..... G08B 13/06

[52] U.S. Cl. ..... 340/568; 335/205; 335/207; 340/572; 340/687; 340/693

[58] Field of Search ..... 340/568, 571, 572, 687, 340/693, 551, 547; 335/205, 207; 330/6; 220/230

[56] References Cited

U.S. PATENT DOCUMENTS

| | | | |
|---|---|---|---|
| 3,199,630 | 8/1965 | Engel et al. | 330/6 |
| 3,668,579 | 6/1972 | Harman | 335/207 |
| 4,295,118 | 10/1981 | Herr et al. | 335/207 |
| 4,536,754 | 8/1985 | Holce et al. | 335/207 |

*Primary Examiner*—Glen R. Swann, III

*Attorney, Agent, or Firm*—David S. Kalmbaugh; J. M. St.Amand

[57] ABSTRACT

A magnetic amplifier housing uses a base, dowel and shunt to magnetizable material to concentrate the magnetic field of a ring magnet through a Hall Effect transistor to provide an improved detector device with increased gain. The detector device causes polarity reversal when tampered with, ensures positive mechanical alignment of the transistor and mechanical components, and protection of the transistor from mechanical damage.

17 Claims, 2 Drawing Sheets

MAGNETIC AMPLIFIER HOUSING AND DETECTOR FOR AN IMPROVED TAMPER ALARM SYSTEM

FIELD OF THE INVENTION

The present invention relates to tamper alarm systems and particularly to a magnetic amplifier housing and detector for a hall transistor used in an intrusion detection system.

BACKGROUND OF THE INVENTION

Hall Effect transistors and magnets are frequently used as components in tamper alarm circuits to detect relative motion, i.e. the opening of a door, window, container, fastener, etc. with respect to a stationary component. Disadvantages of Hall Effect transistors as used in prior art alarm systems and devices are: possible misalignment of transistor and magnet, sensitivity to spurious motion, lower sensitivity, and ease in defeating the systems. The mere use of an external magnet can "spoof" such devices and cause them not to respond when opened. The need to make the alarm systems more tamper resistant is obvious.

SUMMARY OF THE INVENTION

The magnetic amplifier housing of the current invention uses steel dowels and shunts to concentrate the magnetic field of a ring magnet or cluster of magnets through a Hall Effect transistor. A magnetic amplifier housing causes an increase in gain of the transistor and causes polarity reversal when tampered with. In addition, the housing ensures positive mechanical alignment of the transistor and magnet components while protecting the transistor from mechanical damage. A ring magnet or cluster of magnets mounted in a suitable configuration is mounted on one portion of a latch system. A Hall Effect transistor is mounted within a steel housing having a steel dowel which is operable to mesh with the center of the ring magnet. A steel shunt on the ring magnet can be used to concentrate the magnetic field through the center of the magnet. By shunting the magnetic field through the center of the magnet, a higher initial signal is provided when the components are meshed together. This high output drops rapidly when the transistor housing and the shunted ring magnet are pulled apart, and the output voltage reverses before the magnet and transistor housing fully disengage.

It is an object of the invention to provide an improved magnetic amplifier housing for a tamper alarm system.

Another object of the invention is to provide an improved tamper alarm system.

A further object of the invention is to provide an improved detector device for a tamper alarm system.

Other objects, advantages and novel features of the invention will become apparent from the following detailed description of the invention when considered in conjunction with the accompanying drawings, where like numerals refer to like components in each of the figures.

DESCRIPTION OF THE PREFERRED EMBODIMENTS

Figure 1:
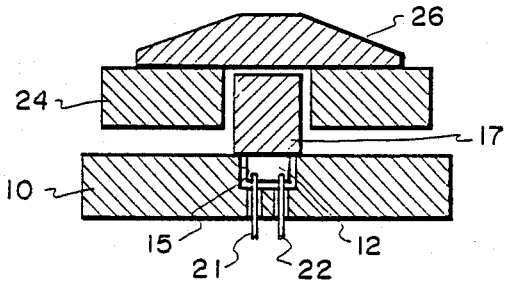
FIG. 1 is a cross-sectional side view of a preferred embodiment of the invention showing an improved magnetic amplifier housing detector with a shunted ring magnet in meshed engagement.
Figure 2:
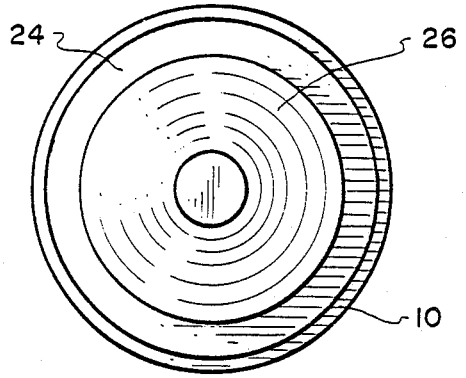
FIG. 2 is a top planar view of the magnetic amplifier device shown in FIG. 1.

An improved magnetic amplifier housing and detector assembly of the present invention is shown in FIGS. 1–5. The assembly base 10, which houses a Hall Effect transistor 12 within a cavity 15, is made from steel or other suitable magnetic material. A steel dowel 17 is mounted over cavity 15 and attached by suitable means to enclose transistor 12 within base 10. Electrical lead wires 21 and 22 pass from base 10, via holes or along a slot, to connect transistor 12 to an alarm circuit, as hereinafter described. Base 10, transistor 12 and steel dowel 17 comprise the lower half of the detector assembly. The upper portion of the detector assembly comprises a ring magnet 24 and a steel shunt 26. Dowel 17 and shunt 26 can also be made from any suitable magnetic materials. Shunt 26 is preferably dome shaped, similar to that shown in FIGS. 1 and 4, for efficiently concentrating the magnetic flux lines. The steel assembly base housing transistor 12 and the shunt 26 cause the magnetic field to be drawn to the least reluctance paths, concentrating the magnetic lines of force through the center of the ring magnet.

Figure 3:
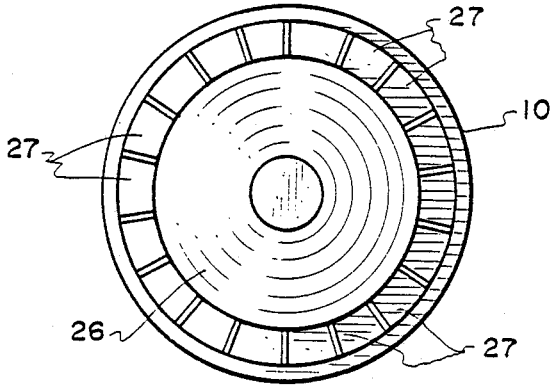
FIG. 3 is a top planar view as in FIG. 2 using a cluster of magnets in place of the ring magnet.
Figure 5:
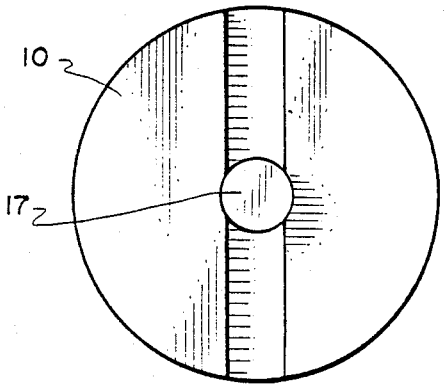
FIG. 5 is a top planar view taken along line 4—4 of FIG. 4.

Ring magnet 24 may be substituted with a cluster of small magnets 27, as shown in FIG. 3, so long as sufficient magnetic field is provided. The cluster of smaller magnets may be in any suitable configuration, in addition to the ring configuration shown. In FIG. 1 the assembly components are shown meshed together, whereas, in FIG. 4 the two halves of the assembly are shown pulled apart.

Figure 6:
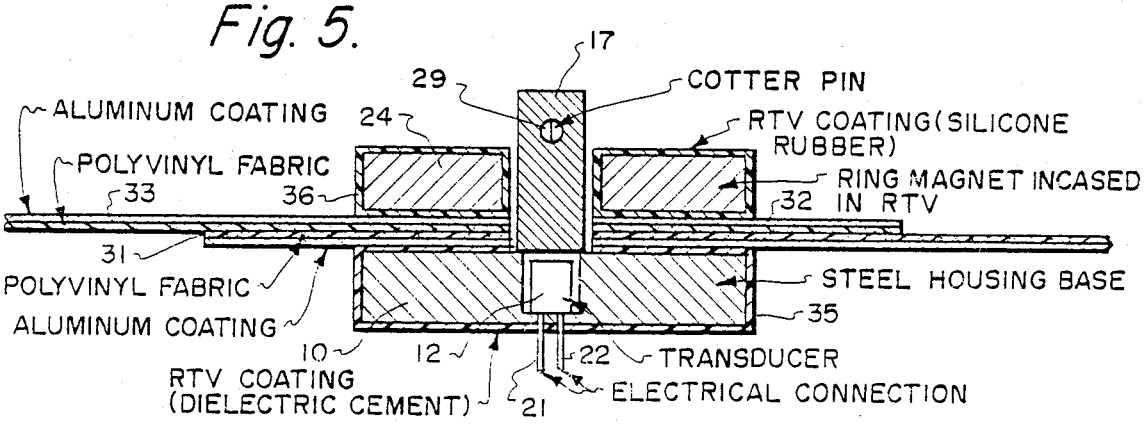
FIG. 6 is a cross-sectional side view of another modification of the invention showing the base with the Hall Effect transistor and the ring magnet of the detector housing meshed together, securing two latch components together.

In the embodiment shown in FIG. 6, dowel 17 is of sufficient length to extend through the ring magnet 24 to allow a fastening means 29, such as a cotter pin or lock, to secure the meshed components of the assembly together. A shunt, such as shunt 26 shown in FIG. 1, can also be used with the ring magnet here, if desired, for more efficient operation. As shown, the meshed together assembly operates to clasp together two overlapping edges 31 and 32 of blanket or wrap-around type closure 33, hereinafter described below in reference to FIG. 11. Both the base 10 and ring magnet 24, shown in FIG. 6, are encased in a silcone rubber or other suitable coatings 35 and 36, respectively, to protect the ferrous materials from the elements and prevent corrosion. Closure 33, as shown, comprises a polyvinyl fabric having an aluminum coating; however, any suitable material for an enclosure may be used to suit the situation.

Figure 4:
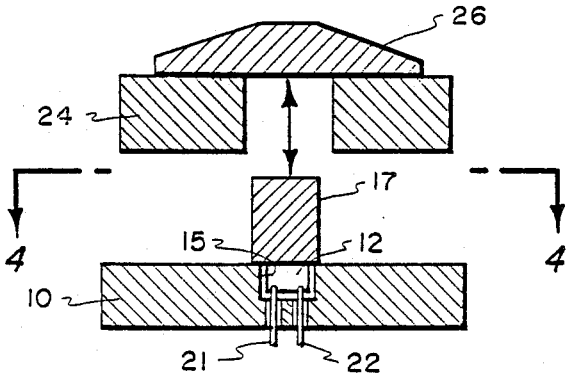
FIG. 4 is a cross-sectional side view, as in FIG. 1, with the detector components open or unmeshed.
Figure 7:
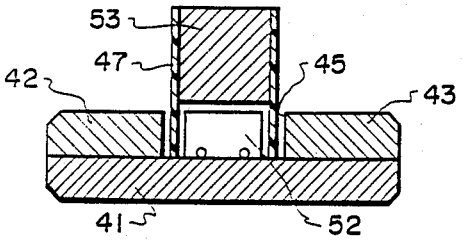
FIG. 7 shows an alternate base structure for the detector shown in FIG. 4.
Figure 8:
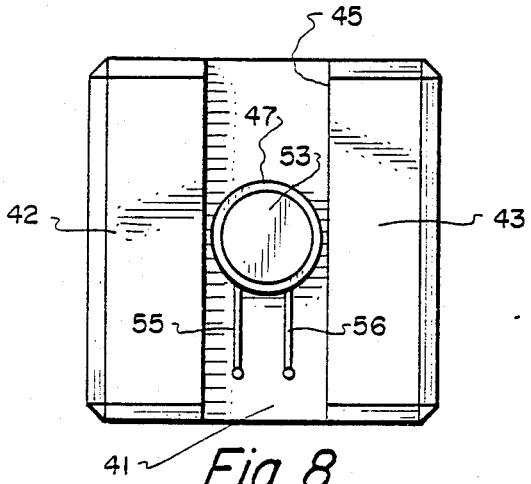
FIG. 8 is a top planar view of the base structure of FIG. 7.
Figure 9:
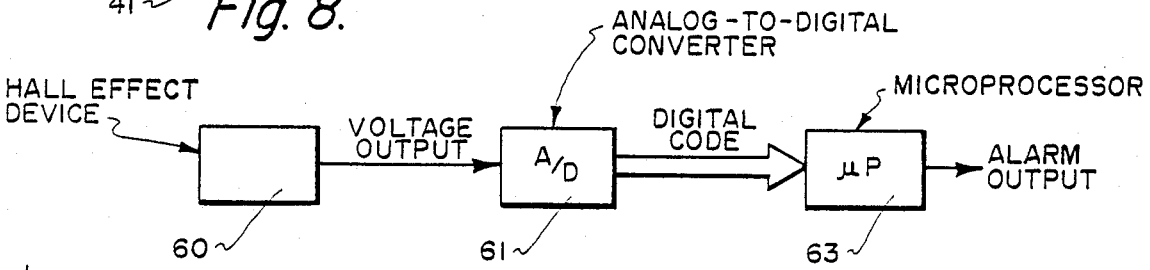
FIG. 9 shows a circuit block diagram for typical operation of the improved detector system.

Illustrated in FIGS. 7 and 8 is the bottom half of another embodiment of the detector assembly, showing a different construction. In this assembly, base 41 is made of steel or other magnetic material. Raised portions 42 and 43, may be made from steel or any suitable magnetic material or from aluminum or any suitable non-magnetic material to suit a particular application. Raised portions 42 and 43 form a groove 45 in which a bushing 47 of brass or suitable strong material is mounted, by brazing, welding, etc., onto base 41. A Hall Effect transistor 52 is housed in the bottom of bushing 47 (or other suitable enclosure) and secured within the bushing with a steel slug closure 53. Suitable electrical lead lines 55 and 56 connect the transistor 50 to an alarm circuit, such as shown in FIG. 9. A ring magnet (or cluster of magnets) and shunt similar to those shown in FIGS. 1 and 4, are used in conjunction with the bottom half assembly of FIGS. 7 and 8. Base 41 and slug 53 of FIGS. 7 and 8 are the equivalent of base 10 and steel dowel 17 shown in FIGS. 1–5 and operate in a similar manner to that described below for FIGS. 1 and 4.

Figure 10:
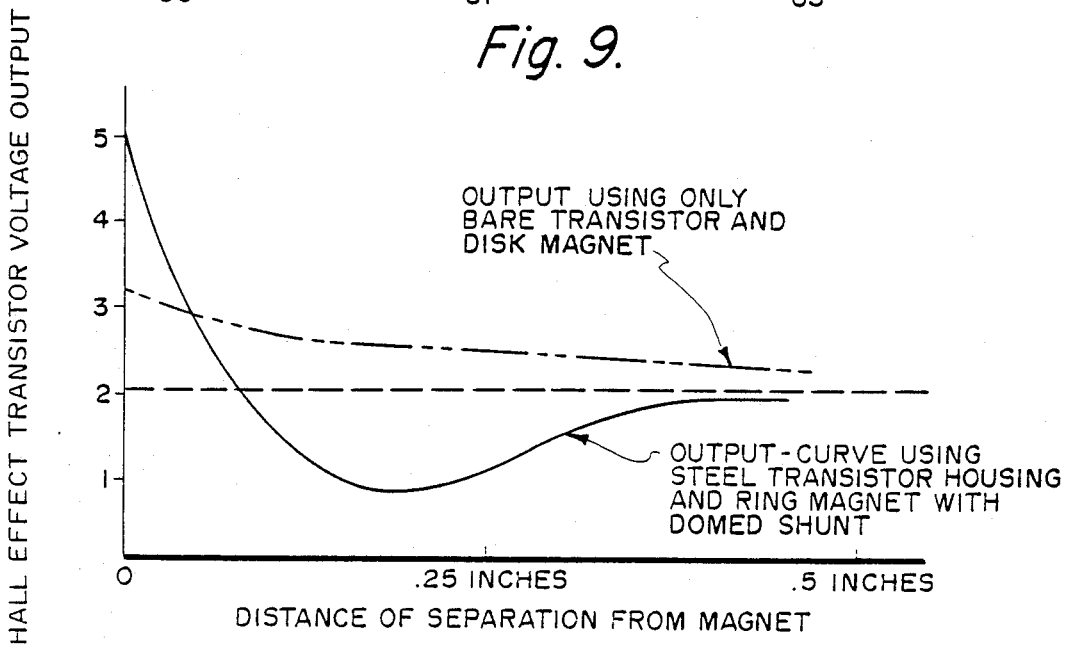
FIG. 10 is a typical performance curve showing transistor voltage output vs. distance of separation from the ring magnet.

The assembly shown in FIGS. 1 and 4, as well as the embodiments shown in FIG. 6 and in FIGS. 7 and 8, operates in the following manner: Assembly base 10, dowel 17 and shunt operate to concentrate the magnetic field of ring magnet 24 through the Hall Effect transistor 12. The assembly housing causes an increase in gain of the Hall Effect transistor and causes polarity reversal when tampered with. While shunt 26 may not always be necessary, it is more efficient in operation of the detector since it concentrates the magnetic field through the center of the magnetic ring. This provides a higher initial signal when the upper and lower components are meshed together as shown in FIG. 1. This high output from the Hall Effect transistor will drop when the two halves of the detector assembly are pulled apart. The output voltage will reverse before the magnet and transistor housing fully disengage, as shown in FIG. 10.

An average reading from the Hall effect device (i.e. setpoint) is calculated when it is enabled, and when the reading deviates from the setpoint by a certain percentage an alarm signal is activated. This is illustrated in the circuit of FIG. 9. When the detector assembly is unlatched, i.e. the ring magnet component is separated from the base housing the transistor, the resultant change in voltage output from the Hall Effect device 60, shown in the circuit of FIG. 9, is fed to an analog-to-digital converter 61 where an alogorithm calculates an average reading from the Hall Effect device and the digital code produced is read by a microprocessor 63 whose output is acted on by an appropriate alarm means. The Hall Effect device 60 represents any of the detector assemblies shown in FIGS. 1, 6 or 7. Typical voltage output curves are shown in FIG. 10 where the output for the detector assembly using only a bare Hall Effect transistor and a disk magnet is shown above the setpoint of the base line of 2.2 volts, and the output using a steel housing and ring magnet with shunt of the present invention is shown as passing from above to below the base line.

Figure 11:
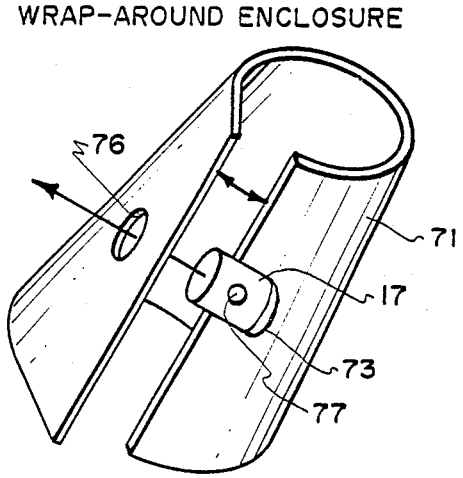
FIG. 11 is an illustration of a wrap-around blanket type closure sleeve using detector components of the present invention to physically clasp the sleeve edges together.

FIG. 11 shows a blanket type wrap-around closure sleeve using a detector assembly of the present invention as a latch means. The wrap-around enclosure 71 may be a vinyl fabric with an aluminum coating as discussed above in regard to FIG. 6 or any suitable material desired for a particular application, or hardware components. As shown in FIG. 11, the housing base is positioned within enclosure 71 with dowel portion 17 protruding through an aperture at 73 in one edge of the enclosure. If desired, the base portion can be cemented within the aperture 73. Then the end of dowel 17 is inserted through aperture 76 in the opposite edge of enclosure 71. A ring magnet 24, such as shown in FIGS. 1 or 6, is then placed around dowel 17 and a pin or other securing means (not shown) is placed through hole 77 in the dowel. Where a shunt 26 is to be used along with a securing pin, the shunt will need to have an aperture which will allow it to fit around the dowel or be configured to fit over the pin.

Obviously many modifications and variations of the present invention are possible in the light of the above teachings. It is therefore to be understood that within the scope of the appended claims, the invention may be practiced otherwise than as specifically described.

What is claimed is:

1. A magnetic amplifier housing and detector for tamper alarm systems, comprising:

a. a base means comprised of ferromagnetic material;

b. a cavity in said base means which houses a Hall Effect device, said Hall Effect device having means for being connected to a remote alarm circuit means;

c. a cap means for said cavity, also made from ferromagnetic material, which is mounted over and encloses said Hall Effect device within said base means and which protrudes outwardly from said base means; said base means, Hall Effect device, and cap means forming a base assembly;

d. a magnet means which is operable to removably fit over and mesh with said protruding cap means of said base assembly, e. said magnet means and said base assembly when meshed together being operable to latch together opposite components of a closure device; said magnet means and said base assembly when meshed together being operable to concentrate the magnetic field of said magnet means through said Hall Effect device to produce a voltage output signal; separation of said magnetic means from said base assembly operable to cause said voltage output signal to change and to reverse before being fully disengaged, wherein the resultant change in voltage output from the Hall Effect device is operable to be acted on by the remote alarm circuit means.

2. A detector device as in claim 1, wherein said magnet means includes a shunt means for concentrating the magnetic field of the magnet means through the Hall Effect device.

3. A detector device as in claim 1, wherein said magnet means is a ring magnet.

4. A detector device as in claim 1, wherein said magnet means comprises a cluster of magnets.

5. A detector device as in claim 1, wherein a dome-shaped shunt means is included to concentrate the magnetic field through the center of said magnet means.

6. A detector device as in claim 1, wherein said cap means protrudes through said magnet means and includes means to lockingly secure said magnet means to said base assembly.

7. A detector device as in claim 1, wherein said magnet means and said base means are insulatively coated against corrosion from the elements.

8. A detector device as in claim 1, wherein said remote alarm circuit comprises an analog-to-digital converter, a microprocessor, and an alarm means; said analog-to-digital converter being operable to calculate a resultant change in voltage reading from said Hall Effect device between a baseline voltage reading after the detector base assembly is enmeshed with said magnet means and the voltage output when the magnet means is separated from the base assembly, and feed a digital code to said microprocessor whose output is in turn acted upon by the alarm means.

9. A magnetic amplifier housing and detector for tamper alarm systems, comprising:

a. a base means comprised of magnetizable material;

b. a Hall Effect device mounted on said base means, said Hall Effect device having means for being connected to a remote alarm circuit means;

c. a cap means, also made from magnetizable material, mounted over said Hall Effect device and which protrudes outwardly from said base means and said Hall Effect device; said base means, Hall Effect device, and cap means forming a base assembly;

d. a magnet means which is operable to removably fit about and mesh with said protruding cap means mounted above said Hall Effect device, e. said magnet means and said base assembly when meshed together being operable to concentrate the magnetic field of said magnet means through said Hall Effect device to produce a voltage output signal; separation of said magnetic means from said base assembly operable to cause said voltage output signal to change and to reverse before being fully disengaged, wherein the resultant change in voltage output from the Hall Effect device is operable to be acted on by the remote alarm circuit means.

10. A detector device as in claim 9, wherein said Hall Effect device is mounted within a bushing type housing and closed with said cap means.

11. A detector device as in claim 9, wherein said magnet means includes a shunt means for concentrating the magnetic field from said magnet means through said Hall Effect device.

12. A detector device as in claim 9, wherein said magnet means comprises a ring magnet.

13. A detector device as in claim 9, wherein said magnet means comprises a cluster of magnets.

14. A detector device as in claim 9, wherein a dome-shaped shunt means is included to concentrate the magnetic field through the center of said magnet means.

15. A detector device as in claim 9, wherein said cap means protrudes through said magnet means and includes means to lockingly secure said magnet means to said base assembly.

16. A detector device as in claim 10, wherein said remote alarm circuit comprises an analog-to-digital converter, a microprocessor, and an alarm means; said analog-to-digital converter operable to calculate a resultant change in voltage reading from said Hall Effect device between a baseline voltage reading made after the detector base assembly is enmeshed with said magnet means and the voltage output when the magnet means is separated from the base assembly, and feed a digital code to said microprocessor whose output is in turn acted upon by the alarm means.

17. A detector device as in claim 10, wherein said magnet means and said base assembly when enmeshed together being operable to latch together opposite components of a closure device to secure the closure device against tampering and unauthorized opening.

* * * * *